United States Patent [19]

Funada et al.

[11] Patent Number: 4,680,505

[45] Date of Patent: Jul. 14, 1987

[54] SMALL SIZE DISCHARGE LAMP HAVING SUFFICIENT ARC LENGTH AND HIGH LUMINOUS EFFICIENCY

[75] Inventors: Fumiaki Funada; Hiroshi Hamada, both of Yamatokoriyama; Osamu Inoue, Himeji, all of Japan

[73] Assignees: Sharp Kabushiki Kaisha, Osaka; Ushio Denki Kabushiki Kaisha, Tokyo, both of Japan

[21] Appl. No.: 788,455

[22] Filed: Oct. 17, 1985

[30] Foreign Application Priority Data

Oct. 17, 1984 [JP] Japan ..... 59-155858[U]
Nov. 15, 1984 [JP] Japan ..... 59-239543
Aug. 6, 1985 [JP] Japan ..... 60-119862[U]

[51] Int. Cl.[4] ..... H01J 61/06; H01J 61/26; H01J 61/30

[52] U.S. Cl. ..... 313/558; 313/573; 313/574; 313/631; 313/634; 313/271

[58] Field of Search ..... 313/573, 634, 574, 631, 313/344, 558, 559, 562, 271, 272

[56] References Cited

U.S. PATENT DOCUMENTS 3,476,969 11/1969 Ennulat et al. ..... 313/634 X
4,461,981 7/1984 Saikatsu et al. ..... 313/558 X

*Primary Examiner*—Palmer C. DeMeo
*Assistant Examiner*—K. Wieder
*Attorney, Agent, or Firm*—Birch, Stewart, Kolasch & Birch

[57] ABSTRACT

A small-size discharge lamp includes a glass tube having first and second ends, with an outer diameter thereof being smaller than 5 millimeters and a length thereof being shorter than 300 millimeters. At opposite ends of the glass tube, an elongated filament and an elongated getter are provided adjacent each other and parallel to the axial direction of the glass tube.

12 Claims, 9 Drawing Figures

SMALL SIZE DISCHARGE LAMP HAVING SUFFICIENT ARC LENGTH AND HIGH LUMINOUS EFFICIENCY

BACKGROUND OF THE INVENTION

1. Field of the Invention

The present invention relates to a small size discharge lamp, and more particularly, to a small size fluorescent lamp of a bar type having, for example, an outer diameter smaller than 5 millimeters, a length less than 300 millimeters and a power less than 10 watts.

2. Description of the Prior Art

Recently, a television receiver which uses a liquid crystal in the screen unit (liquid crystal television) has been developed, and some models of such a receiver have been already released in the market as a pocket size television or a wall handing type television. The screen for such a television receiver is defined by liquid crystal panel. To provide a sufficient luminance of the screen, one or more small size fluorescent lamps, known as the back light, are provided behind the liquid crystal panel. The liquid crystal color television receivers now being released are of two to three inch type, but recently sizes up to about 12 inches have been developed. These television receivers are mostly battery operated and, therefore, it is preferable to operate them with less power. Also, since liquid crystal itself does not produce any light, it is necessary to provide a light source, which must be sufficiently small to fit behind the liquid crystal panel. Furthermore, the operation of the light source should be stable under various conditions and produce a constant light.

According to the prior art small size fluorescent lamp, the outer diameter of the tube is usually greater than 7 miilimeters, having a relatively large heat capacity. Thus, when the heat generation effected at the electrodes is low, i.e., when the power supplied to the lamp is low, the tube will be heated very moderately, resulting in an unstable operation of the lamp, particularly when the ambient temperature is less than, e.g., 5° C. If the temperature falls below 5° C., the temperature of the tube itself does not rise much more than 5° C. Thus, the pressure of the mercury vapor inside the tube will fall thereby deteriorating the luminous efficiency. This will result in an insufficient brightness for the back light.

In many fluorescent lamps, a getter, defined by a plate deposited with mercury, is placed behind the electrodes, i.e., at a space between the electrode and the end of the tube, for enclosing the mercury vapor and also for absorbing unwanted impurity gas generated during the discharge. When this arrangement is employed in a fluorescent tube having a length longer than 400 millimeters, the percentage of the distance between the opposite electrodes with respect to the entire length of the tube is still high, thereby providing a sufficient length of arc between the electrodes. However, when the same arrangement is employed in a small size fluorescent tube having a length shorter than 300 millimeters, said percentage becomes relatively low, resulting in an insufficient length of arc between the electrodes, compared to the total length of the tube.

Furthermore, if the electrode is made of a filament coil, its length should be longer than 3 millimeters. Since 1 millimeter is necessary for the electric connection with a lead wire at each end of the filament coil, the electrode extends with no extra space when it is arranged to be perpendicular to the axial direction of the tube, which has an inner diameter of 5 millimeters. In other words, when the inner diameter of the tube is less than 5 millimeters, the filament coil can not be arranged in the above described manner.

More over, according to the prior art fluorescent lamps, each of the opposite end caps for socketing tube has two terminals. It is preferable to reduce the number of terminals to one to simplify the structure of the end cap.

SUMMARY OF THE INVENTION

The present invention has been developed with a view to substantially solving the above described disadvantages and has for its object to provide an improved small size discharging lamp having a sufficient length of arc with a high luminous efficiency, and the dimension thereof is such that its outer diameter is less than 5 millimeters, its length is shorter than 300 millimeters and its power is less than 10 watts.

In accomplishing these and other objects, a small size discharging lamp according to the present invention comprises a glass tube having first and second ends, with an outer diameter thereof being smaller than 5 millimeters and a length thereof being shorter than 300 millimeters. At opposite ends of the glass tube, an elongated filament and an elongated getter are provided adjacent each other and parallel to the the axial direction of the glass tube.

BRIEF DESCRIPTION OF THE DRAWINGS

These and other objects and features of the present invention will become apparent from the following description taken in conjunction with preferred embodiments thereof with reference to the accompanying drawings, throughout which like parts are designated by like reference numerals, and in which.

DESCRIPTION OF THE PREFERRED EMBODIMENTS

Figure 1:
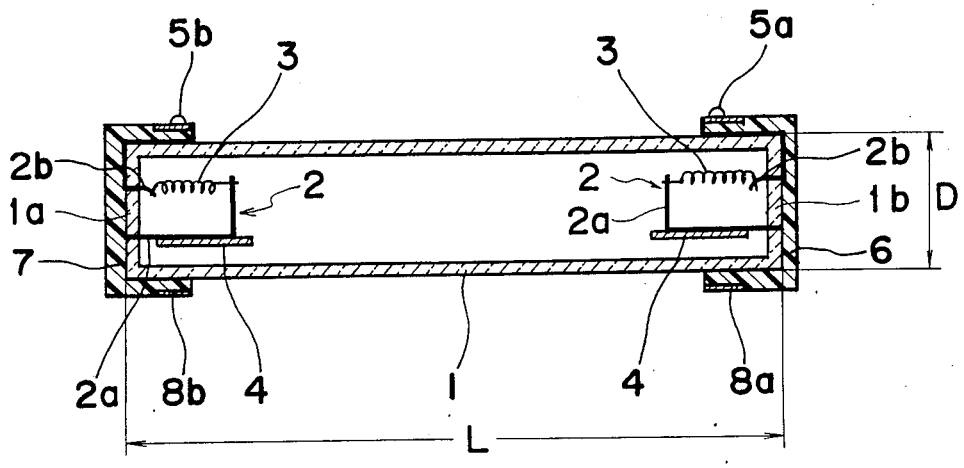
FIG. 1 is a cross sectional view of a small size fluorescent lamp according to a preferred embodiment of the present invention.

Referring to FIG. 1, a small size fluorescent lamp according to the present invention comprises a glass tube 1 having a length L less than 300 millimeters, an outer diameter D less than 5 millimeters, and the thickness of the tube is about 0.3 to 0.7 millimeter. The opposite ends of glass tube 1 is closed by end faces 1*a* and 1*b*. The inside face of the glass tube is supplied with a fluorescent material. The opposite ends of tube 1 have an identical structure. More specifically, an electrode 2 is defined by a filament 3 and lead wires 2*a* and 2*b* extending from the opposite ends of filament 3.

Lead wire 2a has one end fixedly mounted in end face 1a, and extends parallel to the axial direction of glass tube 1. The other end portion of lead wire 2a remote from end face 1a is bent at right angle, and its tip end portion is again bent at right angle such that the end of the lead wire 2a points towards end face 1a.

Lead wire 2b has one end portion extending through end face 1a so as to project the end portion thereof into the glass tube, and the other end portion extending along the outer surface of the glass tube.

Portions of lead wires 2a and 2b which are extending through end face 1a of the glass tube are made of Dumet or cobarl so as to have the same coefficient of thermal expansion as the glass. The other portions of lead wires 2a and 2b are made of nickel or cobarl. In the case where the material of the lead wire between the portion extending through the glass and the portion projecting from the glass is different, these two portions are connected by welding.

Figure 2A:
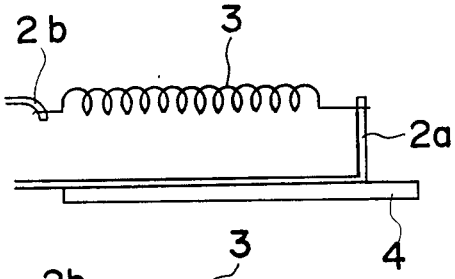
FIGS. 2*a*, 2*b* and 2*c* are schematic views showing the arrangement of coil in three different fashions.
Figure 2B:
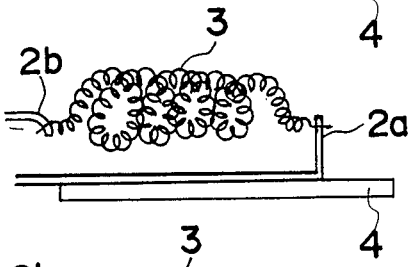
Figure 2C:
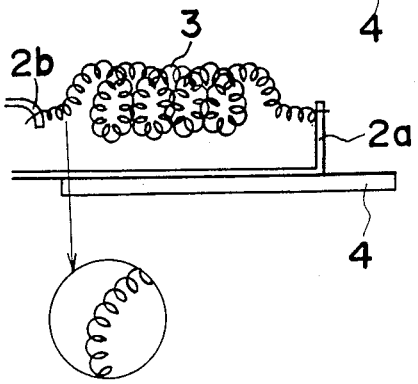

Filament 3, which is made of a material having a high melting temperature, such as a tungsten or molybdenum, has one end connected to the tip end of lead wire 2a, and the other end connected to the tip end of lead wire 2b. The connection between the filament and the lead wire is effected in a known manner, such as spot welding. As shown in FIG. 1, filament 3 extends parallel to the axial direction of the glass tube. Filament 3 can be either a single spiral coil (FIG. 2a), double spiral coil (FIG. 2b) or triple spiral coil (FIG. 2c), or it can be a plain straight line. The line defining the filament is deposited with an electron-emitter which is made of, e.g., oxides or carbonates of alkali metal or alkali earth metal. The weight of filament 3, particularly the section deposited with the electron-emitter, is made as light as possible, such as about 1.0 to 10.0 milligrams so as to reduce its heat capacity. Thus, the temperature of the filament can be easily raised with as little power as possible.

Figure 3A:
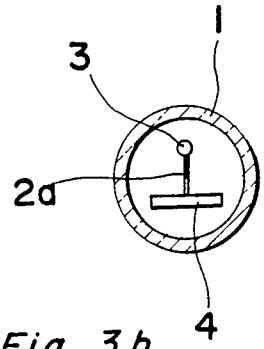
FIG. 3*a* is a cross sectional view of the fluorescent lamp cut perpendicularly to its axial direction.
Figure 3B:
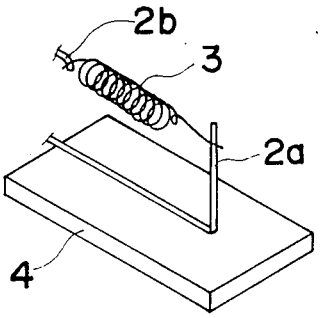
FIG. 3*b* is a perspective view showing the detail of a getter.

A getter 4, having a rectangular plate configuration, as best shown in FIG. 3b, is attached to the lead wire 2a, e.g., by welding. Thus, getter 4 and filament 3 are located side-by-side and parallel to each other, and are well fitted inside the glass tube, as best shown in FIG. 3a. Getter 4 is formed by a rectangular iron plate coated with nickel plating. Also, the outer surface is laminated with a zircon aluminum alloy. Furthermore, the powder of titanium and mercury is applied with a pressure. After getter 4 is installed inside the glass tube, heat is applied to getter 4, for example, by the RF heating method so as to emit mercury vapor from getter 4. In this manner, the mercury vapor will be filled inside the glass tube. The total mercury provided in the glass tube will be about 1 to 5 milligrams. Furthermore, when in use, getter 4 absorbs impurity gas generated during the discharge.

In addition to the mercury vapor, the glass tube will be filled with argon, crypton or neon gas or their mixture gas so that the total pressure of the gas inside the tube will be about 6 to 50 Torr. In this manner the fluorescent lamp according to the present invention is arranged to operate at a power less than 10 watts.

The opposite ends of glass tube 1 are mounted with caps 6 and 7 made of synthetic resin. Caps 6 and 7 have, respectively, metal belts 8a and 8b wound therearound. And, metal belts 8a and 8b are mounted with rounded contact terminals 5a and 5b, respectively. The end of lead wire 2b extending outside the glass tube is connected to the corresponding belt 8a or 8b, as shown in FIG. 1, by way of, e.g., soldering.

It is to be noted that the end of lead wire 2a remote from filament 3 may be electrically disconnected from or connected to lead wire 2b. Also, caps 6 and 7, which have been described as made of synthetic resin, may be formed by a metal. In such a case, the electric connection between lead wires 2a and 2b can be done easily.

The specifications of a small size fluorescent lamp constructed according to the present invention are given in Table 1 below, as an example.

TABLE 1

| | |
|---|---|
| Tube length L | 84 mm |
| Inner diameter | 3.4 mm |
| Arc length | 65 mm |
| Enclosed gas | Argon |
| Pressure of enclosed gas | 40 Torr |
| Mercury quantity | 2 mg |
| Filament | Tungsten |
| Electron emitter | Mixture of Triple carbonate and zirconia |
| Mercury-containing getter | Zr - Al, Ti - Hg |
| Voltage | 60 V |
| Current | 20 mA |
| Power | 1.2 W |

Figure 4:
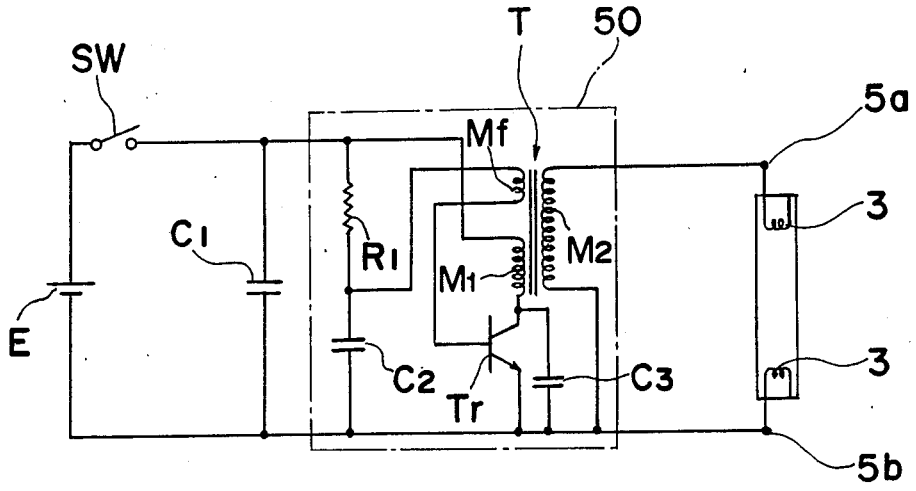
FIG. 4 is a circuit diagram showing a power supply circuit for the fluorescent lamp of the present invention.

Referring to FIG. 4, an example of a driving circuit for driving the fluorescent lamp of the present invention is shown. A DC dry-battery E of, e.g., 6 volts, a switch SW and an electrolytic capacitor C1 are connected in series. A high frequency generator 50 is connected across capacitor C1. Generator 50 comprises a resistor R1, capacitors C2 and C3, a transistor Tr and a high frequency transformer T. Transformer T has a feedback winding Mf, primary winding M1 and secondary winding M2. Feedback winding Mf is connected between a junction between resistor R1 and capacitor C2 and the base of transistor Tr. Primary winding M1 is connected between a junction between capacitor C1 and resistor R1 and the collector of transistor Tr. Secondary winding M2 is connected between terminals 5a and 5b of the fluorescent lamp.

When switch SW is turned on, high frequency generator 50 produces from its secondary winding M2 an output pulse having a frequency between 20 and 50 KHz. Accordingly, an arc discharge is produced between two filaments 3 in the fluorescent lamp to produce light.

Instead of the circuit shown in FIG. 4, the driving circuit may be formed by the use of a push-pull circuit.

According to the present invention, since filament electrode 3 and getter 4 are positioned side-by-side and parallel to the axis of the tube, arc length is maintained substantially equal to the length of the glass tube minus the length of the two filaments. In other words, the arc length will not be changed even after the employment of getters 4. With such a long arc, the luminous efficiency can be maintained at a high level. According to the tests, the fluorescent lamp of the present invention showed as high as 20,000 nt of luminance under the ambient temperature of 20° C. Even after the continuous use of 2,000 hours, the lamp produced sufficient luminance from a practical viewpoint. The fluorescent lamp of the present invention is particularly suitable for use as the back-light for the liquid crystal display, because of its small size and small power.

Since the fluorescent lamp according to the present invention has an outer diameter less than 5 mm, the glass tube of the small-sized fluorescent lamp constructed as described above is subject to a great quantity of heat per unit area from the electrodes. Although it has a length less than 300 millimeters and its power is lower than 4 watts, it can be maintained at a relatively high temperature even when the ambient temperature is low, such as below 5° C. Therefore the low-limit temperature is greatly unrestricted, thereby maintaining the mercury vapor at a relatively high pressure. Thus, even at a low temperature, a high luminous efficiency can be ensured. Thus, even when the fluorescent lamp of the present invention is used as the back-light for the liquid crystal panel, the image on the liquid crystal panel will have a sufficient brightness even when it is used under a low ambient temperatures. Thus, regardless of the temperature, a bright image can be formed on the liquid crystal panel. In the practical use, the fluorescent lamp according to the present invention is particularly suitable for the back-light lamp of a flat panel display using the liquid crystal elements.

Next, various tests performed on the fluorescent lamp of the present invention will be described.

In the first test, a relationship between the luminance of the tube and the ambient temperature is examined. To this end a plurality of, such as six, fluorescent lamps according to the present invention having the following specifications as given in Table 2 are prepared.

TABLE 2

| | |
|---|---|
| Tube diameter (outer) | 4.1 mm |
| Tube length | 110 mm |
| Distance between electrodes | 82 mm |
| Enclosed gas | Argon |
| Gas pressure | 25 Torr |
| Mercury | 1 mg |
| Filament | Tungsten |
| Electron emitter | A mixture of carbonates of barium, strontium and calcium applied by spreading |
| Voltage | 76 V |
| Current | 15 mA |
| Power | 1.1 W |
| luminance (initial value) | 17000 nt |

Figure 5:
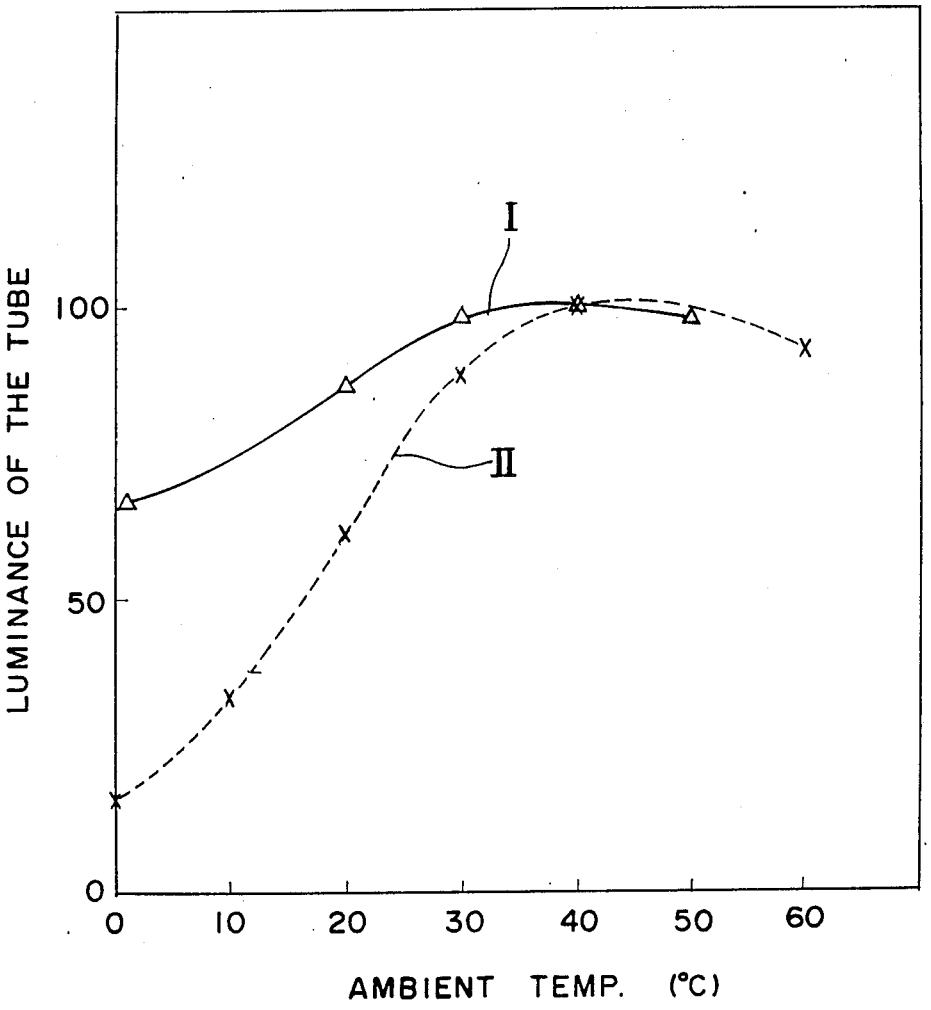
FIG. 5 is a graph showing a relationship between the luminance of the tube and the temperature.

The above data is obtained under the normal operating condition with the ambient temperature 0° C. As indicated in the graph of FIG. 5, line I, the luminance of the tube changed gradually with respect to the change of the ambient temperature, and showed the most bright luminance at the ambient temperature of about 40° C. The curves in the graph are normalized such that the peak point has the luminance of 100. Also, the result shown in the graph is an average of the six test lamps. As apparent from the graph, according to the present invention, the luminance of the tube can be maintained to about 65% of its most bright condition even when the ambient temperature is reduced to 0° C.

Another six lamps are prepared, but has the outer diameter of 7.75 millimeters. Other items are the same as those given in Table 2. When these lamps, prepared for the purpose of comparison, are tested, the luminance of the tube changed rapidly, as shown by line II in the graph of FIG. 5, during the temperature change from 0° C. to 60° C. The graph shows that, with the comparison-purpose lamps, the luminance of the tube is reduced to about 16% of its most bright condition when the ambient temperature is reduced to 0° C. This is not applicable for practical use.

In the second test, the influence caused by the pressure of the gas provided in the glass tube is examined. More specifically, a relationship between the voltage at which the arc can be initiated and the pressure of the gas provided in the glass tube is examined. Also, a relationship between the luminous efficiency and the pressure of the gas is examined. To this end a plurality of fluorescent lamps according to the present invention having different gas pressure are prepared. The items other than the gas pressure are the same as those given in Table 2. To supply the power the circuit of FIG. 4 is employed.

Figure 6:
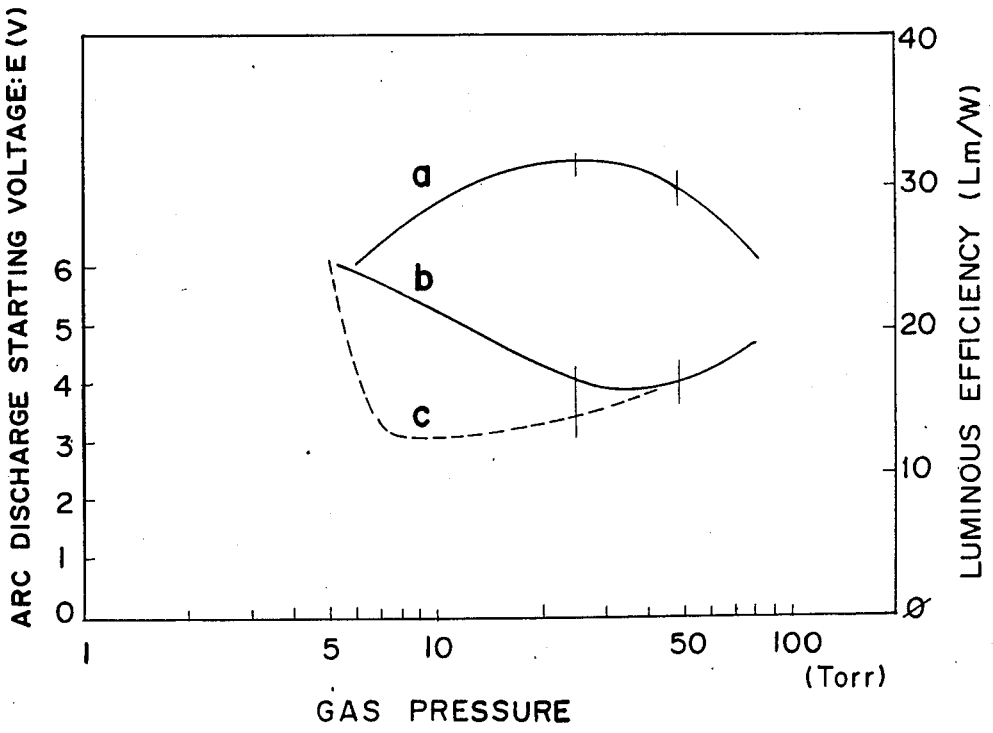
FIG. 6 is a graph showing a relationship between the arc discharge starting voltage and the gas pressure, and also between the luminous efficiency and the gas pressure.

The test results are shown in FIG. 6. A curve a shows a relationship between the luminous efficiency and the pressure of the gas. A curve b shows a relationship between the voltage at which the arc discharge can be initiated (arc discharge starting voltage) and the pressure of the gas provided in the glass tube.

For the purpose of comparison. fluorescent lamps having a heater provided adjacent the filament are tested, using the driving circuit of FIG. 4 further equipped with a circuit for supplying power to the heater. Other than this, the comparison-purpose fluorescent lamps have the same structure as the lamp specified by the items given in Table 2. A curve c in FIG. 6 shows the test result, using the comparison-purpose fluorescent lamps, for obtaining the relationship between the arc starting voltage and the pressure of the gas.

From the test result shown in FIG. 6, the following points can be concluded.

(1) When the pressure of the gas is between 10 to 50 Torr (see curve a), the luminous efficiency is within a reasonable range (about 30 Lm/W or more) from the viewpoint of practical use.

(2) When the pressure of the gas is between 6 to 15 Torr, the arc starting voltage for the lamp of the present invention is relatively high, and that for the comparison-purpose lamp is relatively low. This can be understood such that in the comparison-purpose lamp the heater helps to generate the arc even at the low gas pressure. However, when the gas pressure increases greater than 20 Torr in the lamp of the present invention, the arc can be generated at the low voltage. The difference in the arc starting voltage is very small between the lamp of the present invention and the comparison-purpose lamp when the gas pressure is raised to a range between 20 to 50 Torr (see curves b and c).

Thus, when the gas pressure is between 20 to 50 Torr, the small-size fluorescent lamp according to the present invention can produce arc with no problem without the use of any heating device. Furthermore, the luminous efficiency is a relatively high amount, 30 Lm/W or more, which is sufficient for the practical use.

The present invention is applicable not only to the fluorescent lamp but also to other discharging lamps such as neon lamp, mercury-vapor lamp, sodium-vapor lamp or the like.

Although the present invention has been fully described with reference to a preferred embodiment, many modifications and variations thereof will now be apparent to those skilled in the art, and the scope of the present invention is therefore to be limited not by the details of the preferred embodiment described above, but only by the terms of the appended claims.

What is claimed is:

1. A discharge lamp comprising:

a glass tube having first and second ends, with an outer diameter thereof being smaller than 5 millimeters and a length thereof being shorter than 300 millimeters;

a first electrode means provided at said first end, said first electrode means comprising an elongated filament provided inside said glass tube and extending parallel to an axial direction of said glass tube, said filament being connected to a first lead wire at a first end of the filament and a second lead wire at a second end of the filament;

a second electrode means provided at said second end; and an elongated getter located inside said glass tube, said elongated getter being adjacent and parallel to said elongated filament.

2. A discharge lamp as claimed in claim 1, wherein said getter comprises a metallic plate.

3. A discharge lamp as claimed in claim 1, wherein said first and second electrode means have the same structure, the lamp further comprising a second elongated getter located inside said glass tube, said second elongated getter being adjacent and parallel to the elongated filament of said second electrode means.

4. A discharge lamp as claimed in claim 1, further comprising a gas filled inside said glass tube at pressure between 20 to 50 Torr.

5. A discharge lamp as claimed in claim 1, wherein a power to be supplied thereto is less than 10 watts.

6. A discharge lamp as claimed in claim 1, further comprising a cap mounted at first and second ends of said glass tube.

7. The discharge lamp of claim 1 wherein said filament is selected from a group consisting of a single spiral coil, a double spiral coil and a triple spiral coil.

8. The discharge lamp of claim 2 wherein said getter comprises a rectangular iron plate, said plate being coated with nickel plating, an outer surface thereof being laminated with an alloy.

9. The discharge lamp of claim 4 wherein said gas is selected from a group consisting of argon, krypton and neon.

10. The discharge lamp of claim 6 wherein said cap is of a synthetic resin material.

11. A discharge lamp comprising:

a glass tube having first and second ends, with an outer diameter thereof being smaller than 5 millimeters and a length thereof being shorter than 300 millimeters;

a first electrode means provided at said first end, said first electrode means comprising:

a first wire extending parallel to an axial direction of said glass tube with one end thereof fixedly mounted in said first end and an other end being bent;

a second wire having one end extending through said first end of said glass tube and an other end thereof extending outside said glass tube; and an elongated filament connected between said other end of said first wire and said one end of said second wire such that said elongated filament extends substantially parallel to said axial direction of said glass tube;

an elongated getter provided on said first wire such that said elongated getter extends parallel to said elongated filament; and a second electrode means provided at said second end.

12. A discharge lamp as claimed in claim 11, wherein said second electrode means has the same structure as said first electrode means, the lamp further comprising a second elongated getter, said second elongated getter extending parallel to the elongated filament of said second electrode means.

* * * * *